US010760786B2

(12) United States Patent
Chang

(10) Patent No.: US 10,760,786 B2
(45) Date of Patent: Sep. 1, 2020

(54) JET BURNER

(71) Applicant: PURE METHANOL ENERGY TECHNOLOGY CO., LTD., New Taipei (TW)

(72) Inventor: Teng-Yun Chang, New Taipei (TW)

(73) Assignee: Pure Methanol Energy Technology Co., Ltd., New Taipei (TW)

( * ) Notice: Subject to any disclaimer, the term of this patent is extended or adjusted under 35 U.S.C. 154(b) by 202 days.

(21) Appl. No.: 15/906,380

(22) Filed: Feb. 27, 2018

(65) Prior Publication Data

US 2019/0186733 A1 Jun. 20, 2019

(30) Foreign Application Priority Data

Dec. 15, 2017 (TW) ..... 106144279 A

(51) Int. Cl.

| | |
|---|---|
| ***F23D 14/22*** | (2006.01) |
| ***F23D 14/64*** | (2006.01) |
| ***F23D 14/34*** | (2006.01) |
| ***F23D 11/26*** | (2006.01) |
| ***F23D 11/38*** | (2006.01) |
| ***F23D 11/40*** | (2006.01) |

(52) U.S. Cl.

CPC ..... *F23D 14/22* (2013.01); *F23D 11/26* (2013.01); *F23D 11/38* (2013.01); *F23D 11/404* (2013.01); *F23D 11/406* (2013.01); *F23D 14/34* (2013.01); *F23D 14/64* (2013.01); *F23D 2207/00* (2013.01)

(58) Field of Classification Search

CPC ..... F23D 14/22
USPC ..... 431/188, 189, 8
See application file for complete search history.

(56) References Cited

U.S. PATENT DOCUMENTS 5,302,112 A * 4/1994 Nabors, Jr. ..... F23D 14/22 239/418
6,263,660 B1 * 7/2001 Lawlor ..... F23G 5/46 60/39.35
6,813,889 B2 * 11/2004 Inoue ..... F23R 3/10 60/737

(Continued)

FOREIGN PATENT DOCUMENTS

| | | |
|---|---|---|
| CN | 203412671 U | 1/2014 |
| CN | 205782906 U | 12/2016 |
| FR | 3045782 A1 | 6/2017 |

OTHER PUBLICATIONS

Patent Search and Examination Report Issued by A Foreign Patent Office for Application No. GB1806624.1.

*Primary Examiner* — Avinash A Savani
(74) *Attorney, Agent, or Firm* — Rosenberg, Klein & Lee

(57) ABSTRACT

A jet burner of the present disclosure basically includes a burner unit and an air blower disposed at a rear end of a burning chamber of the burner unit, wherein the burner unit is installed with a fuel bucket for storing fuel and the burning chamber having a tubular shape. Interior of the burning chamber is installed with a least one nozzle, at least one fuel pipe coupled to the fuel bucket is installed at each the nozzle, a front end of the burning chamber is installed with at least one jet pipe, and a pipe diameter of each the jet pipe is less than an inner diameter of the burning chamber. Under the reaction of the jet pipe, the burning stay time of the fuel in the interior of the burning chamber is increased, as to achieve the objective of increasing the fuel burning efficiency.

12 Claims, 9 Drawing Sheets

(56) References Cited

U.S. PATENT DOCUMENTS

2008/0268387 A1* 10/2008 Saito ..... F23R 3/286
431/8
2009/0173075 A1* 7/2009 Miura ..... F23R 3/10
60/737

* cited by examiner

JET BURNER

BACKGROUND

1. Technical Field

The present disclosure relates to a burner, in particular to, a jet burner for sufficiently increasing the fuel burning efficiency.

2. Description of Related Art

According to prior art, the burner is widely used in a boiler, a heating furnace, a drying equipment and an industrial furnace and other thermal machinery, and the basic architecture of the conventional burner is shown as FIG. 1. The conventional burner is installed with a burning chamber 12 coupled to an air blower 11, and interior of the burning chamber 12 is installed with a plurality of nozzles 13 coupled to a fuel providing device (not shown in the drawings). Mainly, the air blower 11 generates the accelerating gas fluid in the burning chamber 12, and after the fuel injected into the burning chamber 12 is fired, accompanying the gas fluid in the burning chamber 12, the fire can be spurted and burned at the front end of the burning chamber 12.

The fuel of the conventional burner is mostly the diesel with good ignitability. Currently, there is also a burner provided as follows. After the burner utilizes a heater to heat the heavy oil to the high temperature of 110 degrees Celsius, the high-pressure pump transfers the heated heavy oil to the firing position via the pipeline, and thus the heavy oil can be the fuel. The most applications of the burners currently are applied thermal machineries and applied heat exchange devices, both of which are directly coupled to the front ends of the burning chambers 12 of the burners, and thus the increased efficiency is entirely determined according to the fuel burning efficiency and the reaction range of the fire at the front end of the burning chamber 12.

Though the conventional burner utilizes the air blower to generate the accelerating gas fluid, in the actual application, the fuel injected into the burning chamber may be blew out from the burning chamber in the non-complete burning status due to the over-reaction of the accelerating gas fluid, such that the conventional burner cannot have the expected fuel burning efficiency.

SUMMARY

To achieve one of objectives mentioned in the present disclosure, the present disclosure provides a jet burner capable of sufficiently increasing the fuel burning efficiency.

An embodiment of the present disclosure provides a jet burner of the present disclosure at least comprising a burner unit and an air blower; wherein: the burner unit is installed with a fuel bucket for storing fuel and a burning chamber having a tubular shape, interior of the burning chamber is installed with at least one nozzle, at least one fuel pipe coupled to the fuel bucket is disposed at each the nozzle, a front end of the burning chamber is installed with at least one jet pipe, and a pipe diameter of each the jet pipe is less than an inner diameter of the burning chamber; the air blower is coupled to the burning chamber.

Accordingly, under the reaction of the jet pipe, the jet burner of the present disclosure can increase the burning stay time of the fuel in the interior of the burning chamber, so as to achieve the objective of increasing the fuel burning efficiency.

Regarding the above features, the jet burner further comprises a high-pressure gas supplying unit; the high-pressure gas providing unit is installed with a gas storage bucket for storing high-pressure gas, and each the nozzle is installed with a high-pressure pipe coupled to the gas storage bucket.

Regarding the above features, the jet burner further comprises a wind speed auxiliary unit; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, and the rear end of the wind speed bucket is installed with a blade and a motor for driving the blade to spin.

Regarding the above features, the jet burner further comprises a control unit; the control unit is installed with a control circuit, a lighter correspondingly disposed in the interior of the burning chamber and a fuel pump coupled to the fuel pipe of each the nozzle, and the control circuit is at least electrically connected to the lighter, the fuel pump and the air blower.

Regarding the above features, the jet burner further comprises a high-pressure gas supplying unit and a wind speed auxiliary unit; the high-pressure gas providing unit is installed with a gas storage bucket for storing high-pressure gas, and each the nozzle is installed with a high-pressure pipe coupled to the gas storage bucket; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, and the rear end of the wind speed bucket is installed with a blade and a motor for driving the blade to spin.

Regarding the above features, the jet burner further comprises a high-pressure gas supplying unit and a control unit; the high-pressure gas providing unit is installed with a gas storage bucket for storing high-pressure gas, and each the nozzle is installed with a high-pressure pipe coupled to the gas storage bucket; the control unit is installed with a control circuit, a lighter correspondingly disposed in the interior of the burning chamber, a fuel pump coupled to the fuel pipe of each the nozzle and a throttle coupled to the high-pressure pipe of each the nozzle, and the control circuit is at least electrically connected to the lighter, the fuel pump, the throttle and the air blower.

Regarding the above features, the jet burner further comprises a wind speed auxiliary unit and a control unit; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, and the rear end of the wind speed bucket is installed with a blade and a motor for driving the blade to spin; the control unit is installed with a control circuit, a lighter correspondingly disposed in the interior of the burning chamber and a fuel pump coupled to the fuel pipe of each the nozzle, and the control circuit is at least electrically connected to the lighter, the fuel pump, the air blower and the motor of the wind speed auxiliary unit.

Regarding the above features, the jet burner further comprises a high-pressure gas supplying unit, a wind speed auxiliary unit and a control unit; the high-pressure gas providing unit is installed with a gas storage bucket for storing high-pressure gas, and each the nozzle is installed with a high-pressure pipe coupled to the gas storage bucket; the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, and the rear end of the wind speed bucket is installed with a blade and a motor for driving the blade to spin; the control unit is installed with a control circuit, a lighter correspondingly disposed in the interior of the burning chamber, a fuel pump coupled to the fuel pipe of each the nozzle and a throttle coupled to the high-pressure pipe of each the nozzle, and the control circuit is at least electrically connected to the lighter, the fuel pump, the throttle, the air blower and the motor of the wind speed auxiliary unit.

Regarding the above features, the wind speed auxiliary unit is installed with a lubricant bucket for storing lubricant and at least one lubricant pipe coupled to the lubricant bucket and a pivot setting location on a rotating axis of the motor.

Regarding the above features, the wind speed auxiliary unit is installed with at least one hatch cover disposed at a bucket side of the wind speed bucket, wherein the hatch cover is capable of opening and closing.

Regarding the above features, the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a bucket side of the wind speed bucket, wherein the hatch cover is capable of opening and closing.

Regarding the above features, the high-pressure gas supplying unit is further installed with an air compressor coupled to the gas storage bucket, and the air compressor is electrically connected to the control circuit of the control unit.

Regarding the above features, the high-pressure gas supplying unit is further installed with an air compressor coupled to the gas storage bucket, and the air compressor is electrically connected to the control circuit of the control unit; and the wind speed auxiliary unit is installed with a lubricant bucket for storing lubricant and at least one lubricant pipe coupled to the lubricant bucket and a pivot setting location on a rotating axis of the motor.

Regarding the above features, the high-pressure gas supplying unit is further installed with an air compressor coupled to the gas storage bucket, and the air compressor is electrically connected to the control circuit of the control unit; and the wind speed auxiliary unit is installed with at least one hatch cover disposed at a bucket side of the wind speed bucket, wherein the hatch cover is capable of opening and closing.

Regarding the above features, the high-pressure gas supplying unit is further installed with an air compressor coupled to the gas storage bucket, and the air compressor is electrically connected to the control circuit of the control unit; the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a bucket side of the wind speed bucket, wherein the hatch cover is capable of opening and closing.

Mainly under the reaction of the jet pipe, the jet burner provided by the present disclosure can increase the burning time of the fuel in the interior of the burning chamber to achieve the objective of increasing the fuel burning efficiency. Further by using the effect which the high-pressure gas supplying unit accelerates the fuel which incomes the nozzle, the atomization effect of the fuel which has passed the nozzle is increased, and simultaneously, the gas fluid flux is provided to the interior burning chamber to increase the fuel burning efficiency. Even, under the reaction of the wind speed auxiliary unit, the flowing speed and flowing flux of the accelerated gas fluid are increased, such that the relatively positive and reliable means for increasing the fuel burning efficiency and the performance are provided, and the effect of the high temperature on the relative units can be prevented. Furthermore, by using the jet burner, not only the pollutant generated by burning the diesel and the heavy oil can be reduced, but also it eases the alcohol to be the fuel, such that the jet burner can be used in the room environment of the restaurant, organization or school.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
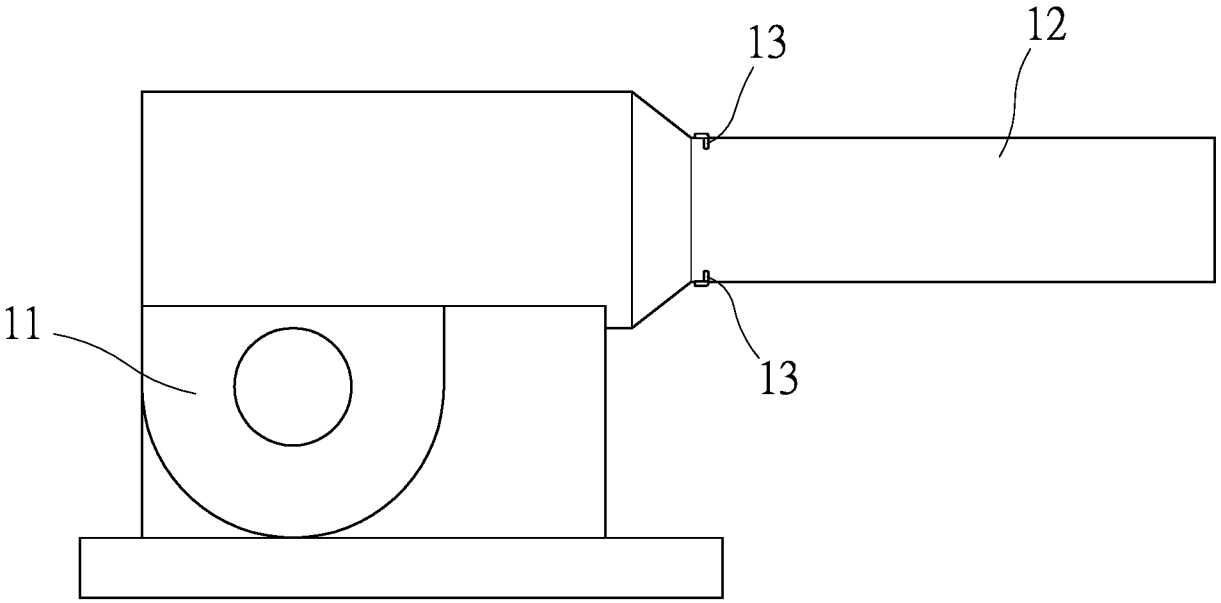
FIG. 1 Prior Art
FIG. 1 is architecture diagram of a conventional burner.
Figure 2:
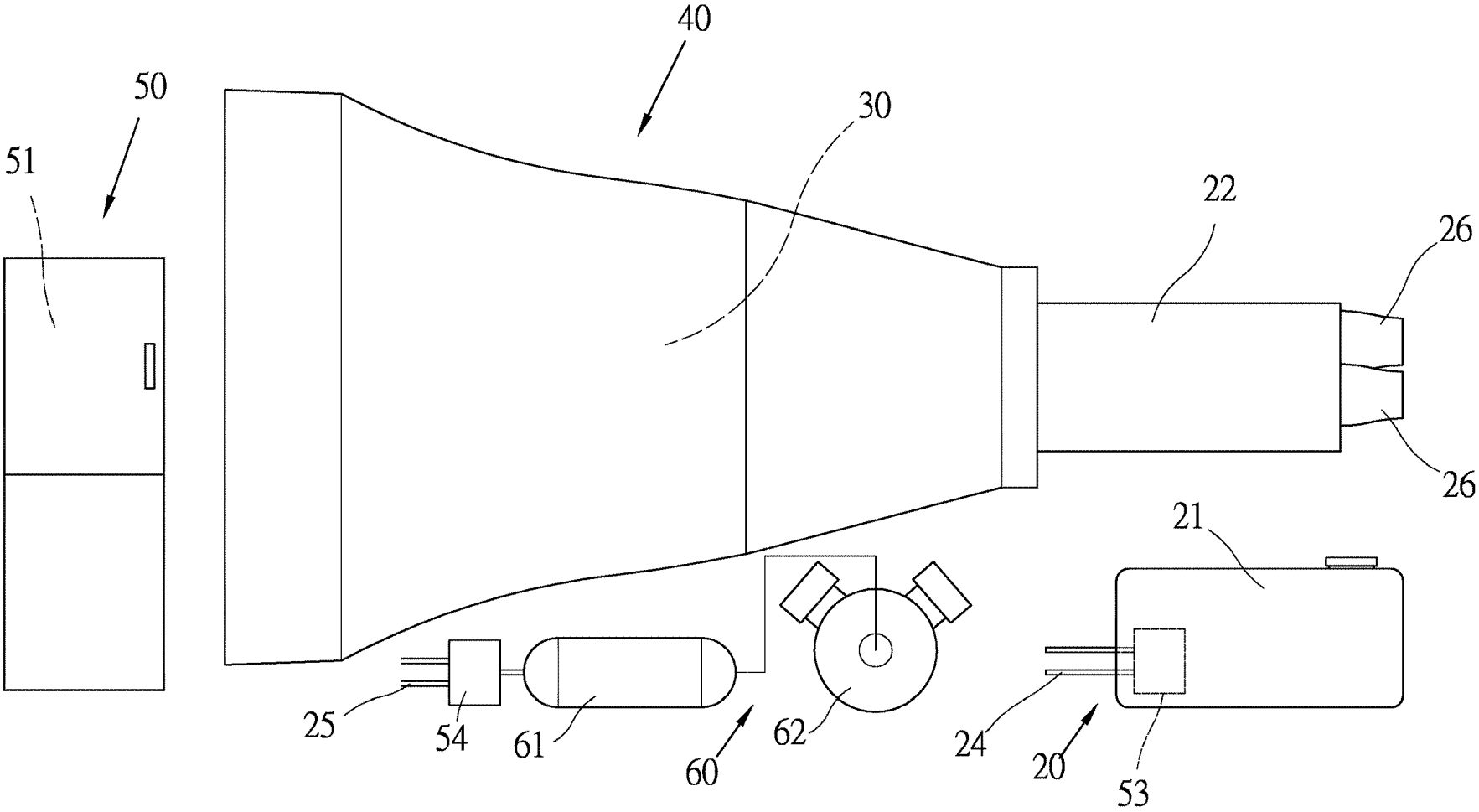
FIG. 2 is a basic architecture diagram of a jet burner according to a first embodiment of the present disclosure.
Figure 3:
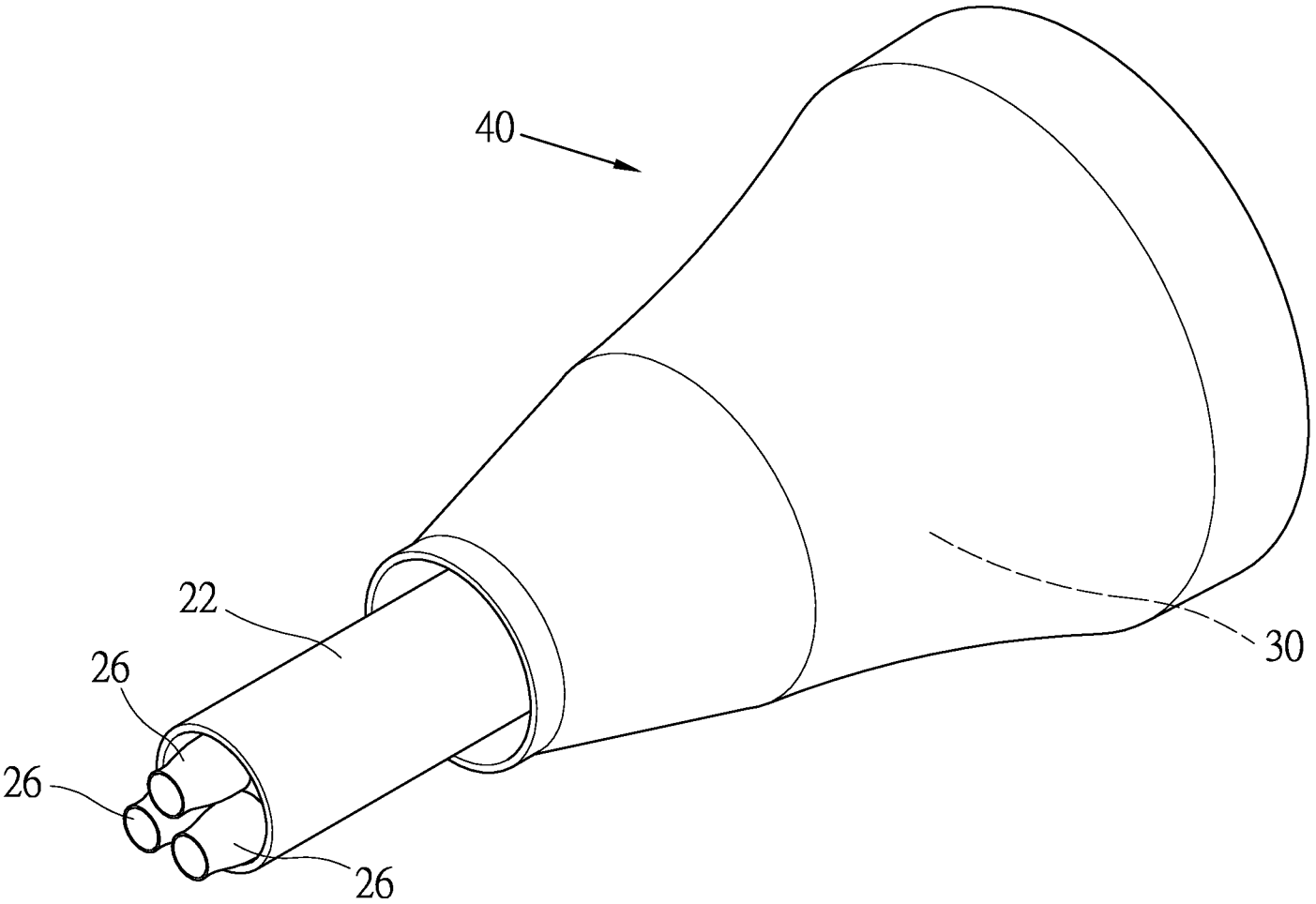
FIG. 3 is a three-dimensional outline diagram of a burning chamber in respective to a front view of the present disclosure.
Figure 4:
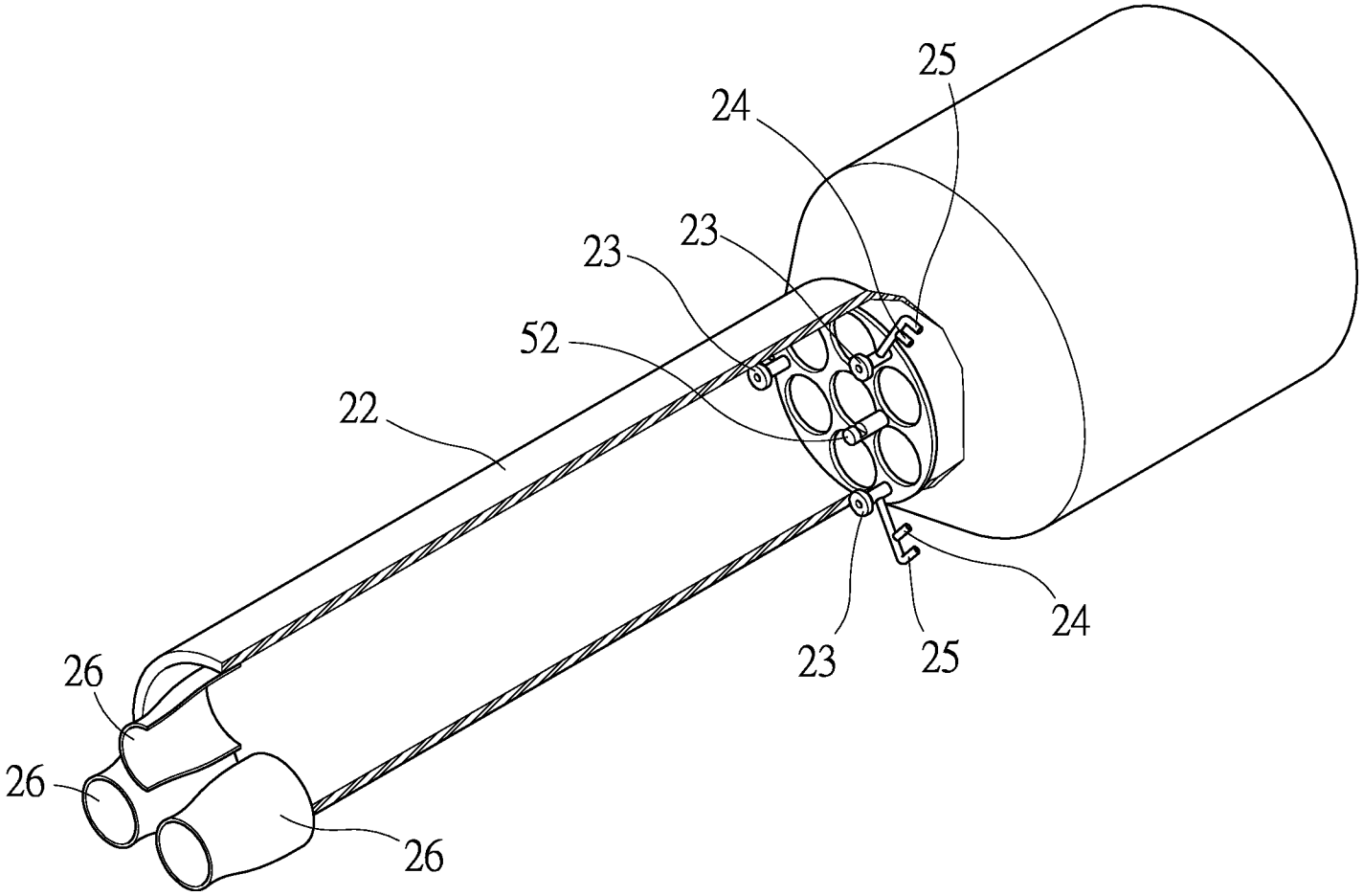
FIG. 4 is a sectional architecture diagram of a burning chamber of the present disclosure.

To understand the technical features, content and advantages of the present disclosure and its efficacy, the present disclosure will be described in detail with reference to the accompanying drawings. The drawings are for illustrative and auxiliary purposes only and may not necessarily be the true scale and precise configuration of the present disclosure. Therefore, the scope of the present disclosure should not be limited to the scale and configuration of the attached drawings.

The present disclosure mainly provides a jet burner for sufficiently increasing the fuel burning efficiency, the jet burner of the present disclosure basically comprises a burner unit 20 and an air blower 30 as shown in FIG. 2 through FIG. 5, and the details are illustrated as follows.

The burner unit 20 is installed with a fuel bucket 21 for storing fuel and a burning chamber 22 having a tubular shape, wherein interior of the burning chamber 22 is installed with at least one nozzle 23, at least one fuel pipe 24 coupled to the fuel bucket 21 is disposed at each the nozzle 23, a front end of the burning chamber 22 is installed with at least one jet pipe 26, and a pipe diameter of each the jet pipe 26 is less than an inner diameter of the burning chamber 22.

The air blower 30 is coupled to the burning chamber 22, such that the gas fluid can be boosted by the air blower 30 and then provided to burning chamber 22. In one embodiment, the air blower 30 is disposed at a rear end of the burning chamber 22, and a wind blowing direction of the air blower 30 is parallel to an axis of the burning chamber 22. Alternatively, in another one embodiment, the air blower 30 is coupled to the burning chamber 22 via a pipe line (not shown in the drawings), wherein the pipe line communicates with the air blower 30 and the burning chamber 22, such that the gas fluid boosted by the air blower 30 can be provided to the burning chamber 22. In the practical implementation, the air blower 30 is preferably disposed on the axis of the burning chamber 22.

Figure 6:
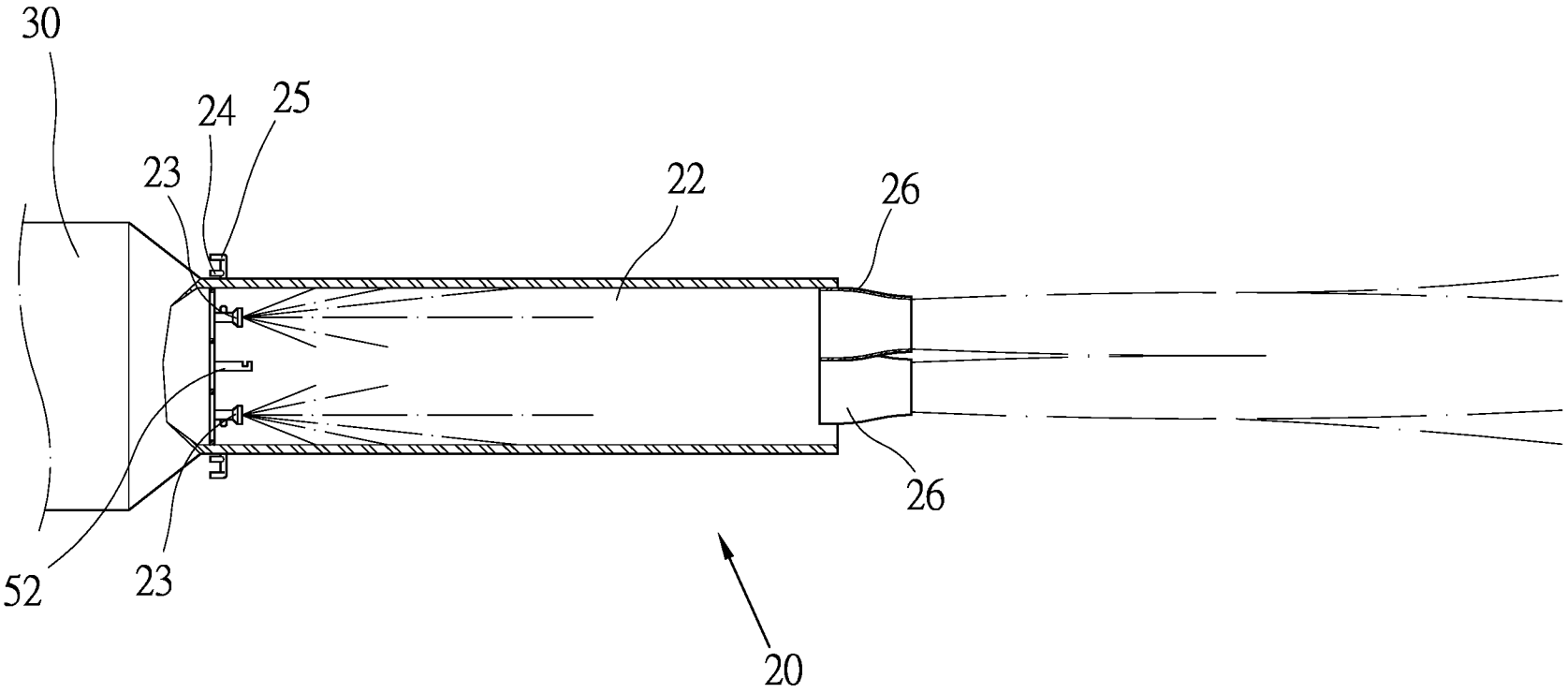
FIG. 6 is an operation diagram of a jet burner of the present disclosure.

Principally, when the jet burner is operating, under the reaction of the jet pipes 26, the burning stay time of the fuel in the interior of the burning chamber 22 can be increased (as shown in FIG. 6), so as to achieve the objective of increasing the fuel burning efficiency.

Moreover, when the jet burner of the present disclosure is implemented, the jet burner can further comprise a high-pressure gas supplying unit 60. The high-pressure gas providing unit 60 is installed with a gas storage bucket 61 for storing high-pressure gas, and each the nozzle 23 is installed with a high-pressure pipe 25 coupled to the gas storage bucket 61. In the practical implementation, the high-pressure gas supplying unit 60 can further comprise an air compressor 62 coupled to the gas storage bucket 61, and under the operation of the air compressor 62, the high-pressure gas is continuously provided.

Figure 5:
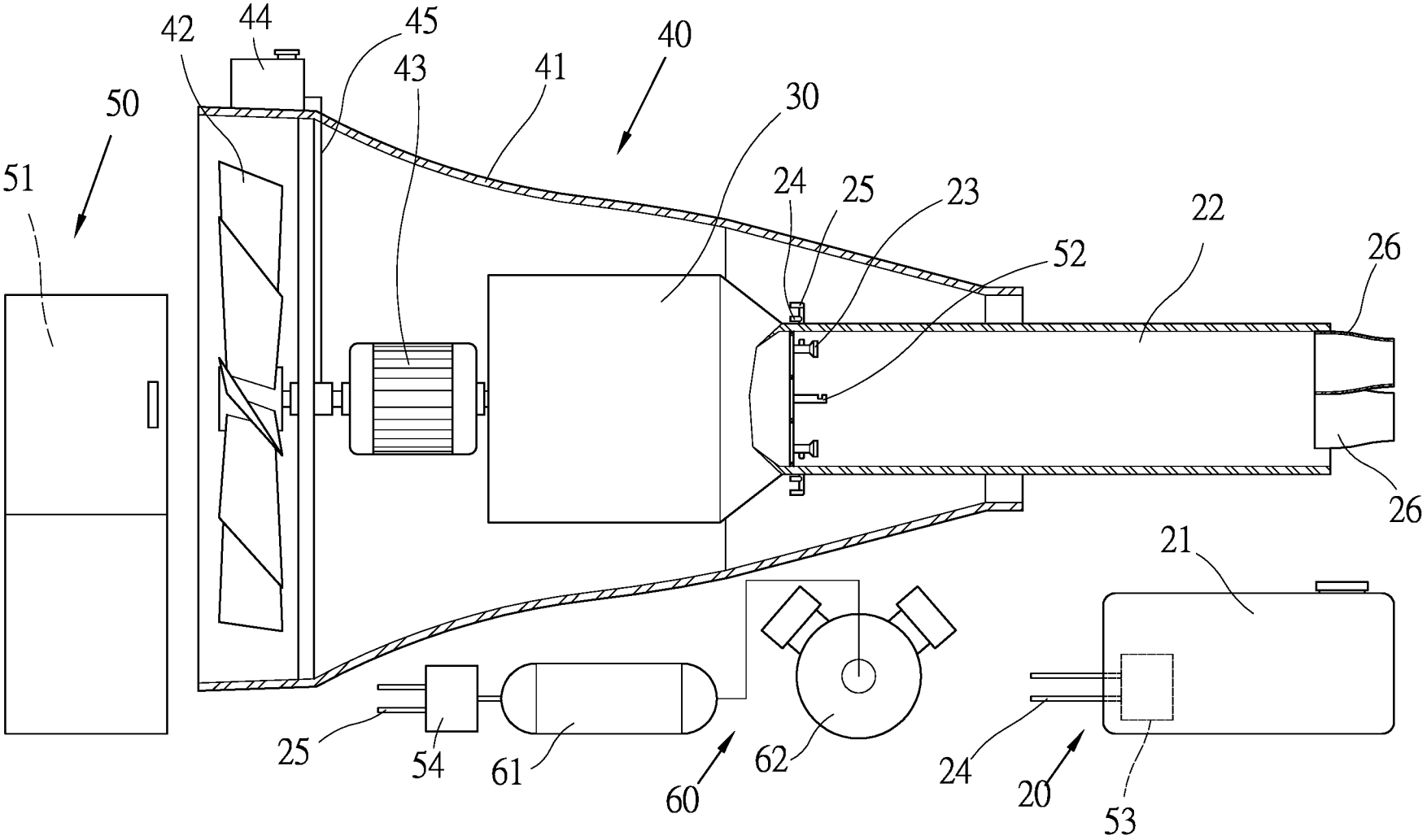
FIG. 5 is a sectional architecture diagram of a jet burner according to a first embodiment of the present disclosure.
Figure 7:
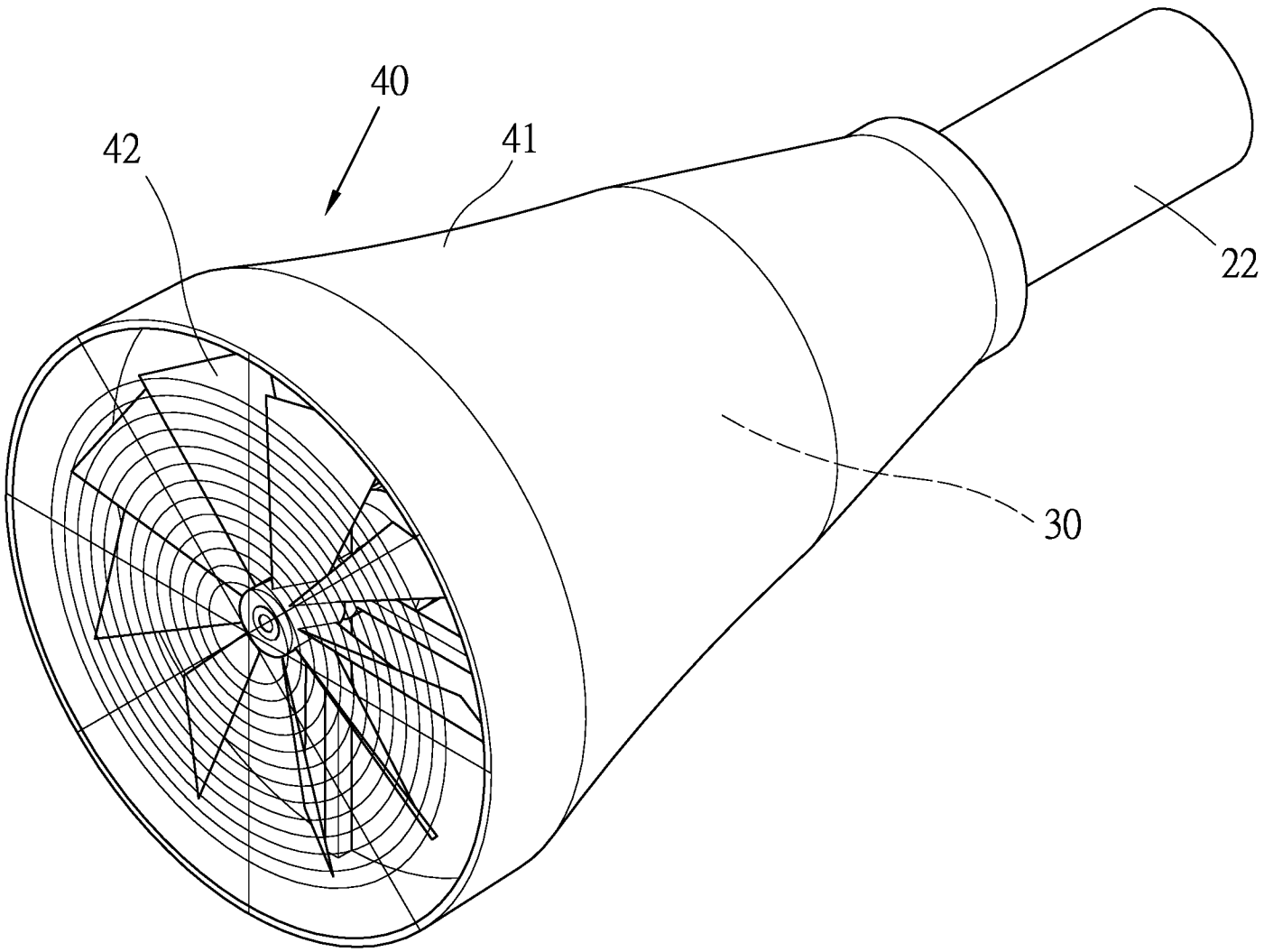
FIG. 7 is a three-dimensional outline diagram of a burning chamber and a wind speed auxiliary unit according to a first embodiment of the present disclosure.
Figure 8:
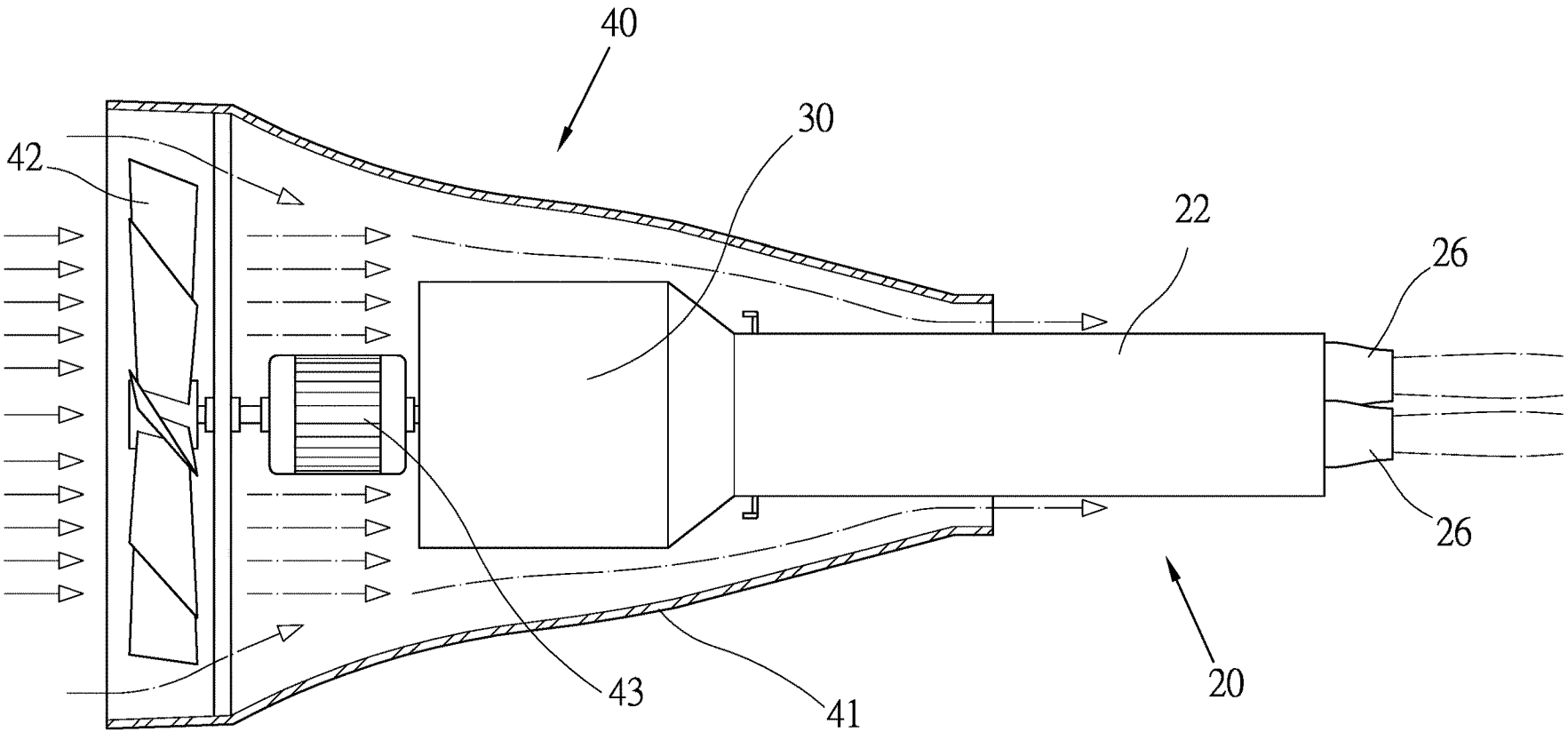
FIG. 8 is an operation diagram of a wind speed auxiliary unit of the present disclosure.

Simultaneously refer to FIG. 5, FIG. 7 and FIG. 8. When the jet burner of the present disclosure is implemented, the jet burner can further comprise a wind speed auxiliary unit 40. The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, and the rear end of the wind speed bucket 41 is installed with a blade 42 and a motor 43 for driving the blade 42 to spin.

Accordingly, under the operating reaction of the blade 42 of the wind speed auxiliary unit 40 (as shown in FIG. 7), the gas fluid flux of the air blower 30 is increased, and not only the flowing speed and flux of the accelerated gas fluid are increased, but also partial flow fluid is accelerated to pass the gap between the wind speed bucket 41 and the air blower 30, so as to increase the waste thermal emission rates of the air blower 30 and the motor 43. Therefore, the relatively positive and reliable means for preventing the relative units from the effect of the high temperature can be provided.

It is noted that, since the jet burner of the present disclosure can increase the flowing speed and flux of the accelerated under the reaction of the wind speed auxiliary unit 40, the dimension of the air blower can be reduced. Even by the design that the air blower 30 is disposed on the axis of the burning chamber 22, the outline shapes of all of the burning chamber 22, the air blower 30 and the wind speed auxiliary unit 40 can be integrated, and this helps the development of easing the miniature and compact of the burner.

When the jet burner of the present disclosure is implemented, the jet burner can further comprise a control unit 50. The control unit 50 is installed with a control circuit 51, a lighter 52 correspondingly disposed in the interior of the burning chamber 22 and a fuel pump 53 coupled to the fuel pipe 24 of each the nozzle 23, and the control circuit 51 is at least electrically connected to the lighter 52, the fuel pump 53 and the air blower 30.

Accordingly, when the control circuit 51 of the control unit 50 loads or sets the related work items or parameters, whether the lighter 52, the fuel pump 53 and the air blower 30 works or not is controlled by the control circuit 51 according to the loaded and set work items and parameters, so as to achieve the objective of automatic operation.

When the jet burner of the present disclosure is implemented, the jet burner can further comprise a high-pressure gas supplying unit 60 and the wind speed auxiliary unit 40. The high-pressure gas providing unit 60 is installed with a gas storage bucket 61 for storing high-pressure gas, and each the nozzle 23 is installed with a high-pressure pipe 25 coupled to the gas storage bucket 61. The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, and the rear end of the wind speed bucket 41 is installed with a blade 42 and a motor 43 for driving the blade 42 to spin.

When the jet burner of the present disclosure is implemented, the jet burner can further comprise a high-pressure gas supplying unit 60 and a control unit 50. The high-pressure gas providing unit 60 is installed with a gas storage bucket 61 for storing high-pressure gas, and each the nozzle 23 is installed with a high-pressure pipe 25 coupled to the gas storage bucket 61. The control unit 50 is installed with a control circuit 51, a lighter 52 correspondingly disposed in the interior of the burning chamber 22, a fuel pump 53 coupled to the fuel pipe 24 of each the nozzle 23 and a throttle 54 coupled to the high-pressure pipe 25 of each the nozzle 23, and the control circuit 51 is at least electrically connected to the lighter 52, the fuel pump 53, the throttle 54 and the air blower 30.

When the jet burner of the present disclosure is implemented, the jet burner can further comprise a wind speed auxiliary unit 40 and a control unit 50. The wind speed auxiliary unit 40 is installed with a wind speed bucket 41 at least covering exterior of the air blower 30, a front end and a rear end of the wind speed bucket 41 are open, a gap for providing passage of a gas fluid is formed between the wind speed bucket 41 and the air blower 30, and the rear end of the wind speed bucket 41 is installed with a blade 42 and a motor 43 for driving the blade 42 to spin. The control unit 50 is installed with a control circuit 51, a lighter 52 correspondingly disposed in the interior of the burning chamber 22 and a fuel pump 53 coupled to the fuel pipe 24 of each the nozzle 23, and the control circuit 51 is at least electrically connected to the lighter 52, the fuel pump 53, the air blower 30 and the motor 43 of the wind speed auxiliary unit 40.

Certainly, when the jet burner of the present disclosure is implemented, the jet burner can further comprise the high-pressure gas supplying unit 60, the wind speed auxiliary unit 40 and the control unit 50. The high-pressure gas providing unit 60 is installed with the gas storage bucket 61 for storing the high-pressure gas, and each the nozzle 23 is installed with the high-pressure pipe 25 coupled to the gas storage bucket 61. The wind speed auxiliary unit 40 is installed with the wind speed bucket 41 at least covering exterior of the air blower 30, the front end and the rear end of the wind speed bucket 41 are open, the gap for providing passage of the gas fluid is formed between the wind speed bucket 41 and the air blower 30, and the rear end of the wind speed bucket 41 is installed with the blade 42 and the motor 43 for driving the blade 42 to spin. The control unit 50 is installed with the control circuit 51, the lighter 52 correspondingly disposed in the interior of the burning chamber 22, the fuel pump 53 coupled to the fuel pipe 24 of each the nozzle 23 and the throttle coupled to the high-pressure pipe 25 of each the nozzle 23, and the control circuit 51 is at least electrically connected to the lighter 52, the fuel pump 53, the air blower 30, the throttle 54 and the motor 43 of the wind speed auxiliary unit 40.

According to the above possible implementations of the present disclosure, the wind speed auxiliary unit 40 is installed with a lubricant bucket 44 (as shown in FIG. 5) for storing lubricant and at least one lubricant pipe 45 coupled to the lubricant bucket 44 and a pivot setting location on a rotating axis of the motor 43. By using the lubricant bucket 44 and the lubricant pipe 45 to usually provide the lubricant to the pivot setting location of the motor 43, the motor 43 is ensured to operate successfully, and the entire operating performance of the jet burner can be increased.

Figure 9:
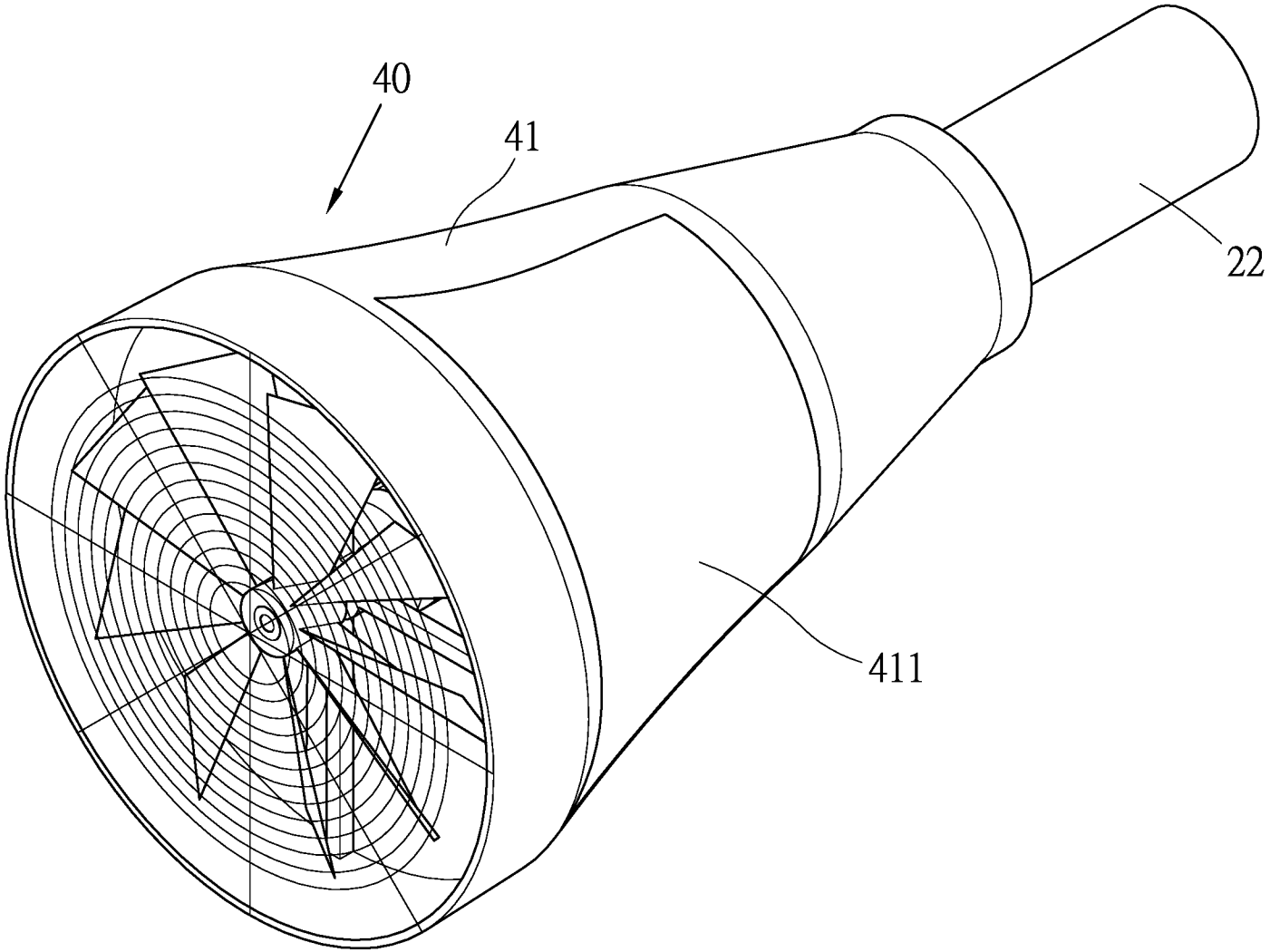
FIG. 9 is a three-dimensional outline diagram of a burning chamber and a wind speed auxiliary unit according to a second embodiment of the present disclosure.

Simultaneously refer to FIG. 9. According to the above possible implementations of the present disclosure, the wind speed auxiliary unit 40 is installed with at least one hatch cover 411 disposed at a bucket side of the wind speed bucket 41, wherein the hatch cover 411 is capable of opening and closing. By using the design of the hatch cover 411, the objective of easing the installation and checking of the related units can be achieved.

Of course, as shown by both of FIG. 5 and FIG. 9, the wind speed auxiliary unit 40 is further installed with the lubricant bucket 44 for storing the lubricant and the at least one lubricant pipe 45 coupled to the lubricant bucket 44 and the pivot setting location on the rotating axis of the motor 43, and the wind speed bucket 41 is preferably installed with the at least one hatch cover 411 disposed at the bucket side of the wind speed bucket 41, wherein the hatch cover 411 is capable of opening and closing.

Moreover, in the embodiment that the jet burner comprises the control unit 50 and the high-pressure gas supplying unit 60 which is further installed with the air compressor 62 coupled to the gas storage bucket 61, the air compressor 62 is electrically connected to the control unit 51 of the control unit 50, and under the operation of the air compressor 62, the high-pressure gas is continuously provided.

Under the embodiment that the jet burner of the present disclosure comprises the control unit 50 and the high-pressure gas supplying unit 60 further installed with the air compressor 62 coupled to the gas storage bucket 61, and the air compressor 62 is electrically connected to the control circuit of the control unit 50, the wind speed auxiliary unit 40 can be further installed with the lubricant bucket 44 for storing the lubricant and the at least one lubricant pipe 45 coupled to the lubricant bucket 44 and the pivot setting location on the rotating axis (i.e. the bearing position) of the motor 43.

Under the embodiment that the jet burner of the present disclosure comprises the control unit 50 and the high-pressure gas supplying unit 60 further installed with the air compressor 62 coupled to the gas storage bucket 61, and the air compressor 62 is electrically connected to the control circuit of the control unit 50, the wind speed auxiliary unit 40 is installed with the at least one hatch cover 411 disposed at the bucket side of the wind speed bucket 41, wherein the hatch cover 411 is capable of opening and closing.

Certainly, under the embodiment that the jet burner of the present disclosure comprises the control unit 50 and the high-pressure gas supplying unit 60 further installed with the air compressor 62 coupled to the gas storage bucket 61, and the air compressor 62 is electrically connected to the control circuit of the control unit 50, the wind speed auxiliary unit 40 can be further installed with the lubricant bucket 44 for storing the lubricant and the at least one lubricant pipe 45 coupled to the lubricant bucket 44 and the pivot setting location on the rotating axis (i.e. the bearing position) of the motor 43, and the wind speed auxiliary unit 40 is preferably installed with the at least one hatch cover 411 disposed at the bucket side of the wind speed bucket 41, wherein the hatch cover 411 is capable of opening and closing.

Compared with the conventional prior art, the jet burner disclosed by the present disclosure, under the reaction of the jet pipe, the burning time of the fuel in the interior of the burning chamber is increased to achieve the objective of increasing the fuel burning efficiency. By using the effect which the high-pressure gas supplying unit accelerates the micro atomization of the fuel incoming the nozzle, the fuel molecules is more refined and burned more completely, such that the objective of increasing the fuel burning efficiency. Further under the reaction of the air blower, the gas fluid incoming the burning chamber is increased, such that the fuel is burned more completely to increase the fuel burning efficiency. Even, under the reaction of the wind speed auxiliary unit, the flowing speed and flowing flux of the accelerated gas fluid are increased, such that the relatively positive and reliable means for increasing the fuel burning efficiency and the performance are provided, and the effect of the high temperature on the relative units can be prevented. Furthermore, by using the jet burner, not only the pollutant generated by burning the diesel and the heavy oil can be reduced, but also it eases the alcohol to be the fuel, such that the jet burner can be used in the room environment of the restaurant, organization or school.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A jet burner, at least comprising: a burner unit and an air blower;

wherein:

the burner unit is installed with a fuel bucket for storing fuel and a burning chamber having a tubular shape, interior of the burning chamber is installed with at least one nozzle, at least one fuel pipe coupled to the fuel bucket is disposed at each the nozzle, a front end of the burning chamber is installed with at least one jet pipe, and a pipe diameter of each the jet pipe is less than an inner diameter of the burning chamber; the air blower is coupled to the burning chamber;

wherein the jet burner further comprises a wind speed auxiliary unit and a control unit the wind speed auxiliary unit is installed with a wind speed bucket at least covering exterior of the air blower, a front end and a rear end of the wind speed bucket are open, a gap for providing passage of a gas fluid is formed between the wind speed bucket and the air blower, and the rear end of the wind speed bucket is installed with a blade and a motor for driving the blade to spin; the control unit is installed with a control circuit, a lighter correspondingly disposed in the interior of the burning chamber and a fuel pump coupled to the fuel pipe of each the nozzle, and the control circuit is at least electrically connected to the lighter, the fuel pump, the air blower, and the motor of the wind speed auxiliary unit.

2. The jet burner according to claim 1, wherein the jet burner further comprises a high-pressure gas supplying unit; the high-pressure gas providing unit is installed with a gas storage bucket for storing high-pressure gas, and each the nozzle is installed with a high-pressure pipe coupled to the gas storage bucket.

3. The jet burner according to claim 1, wherein the jet burner further comprises a high-pressure gas supplying unit; the high-pressure gas providing unit is installed with a gas storage bucket for storing high-pressure gas, and each the nozzle is installed with a high-pressure pipe coupled to the gas storage bucket.

4. The jet burner according to claim 1, wherein the wind speed auxiliary unit is installed with a lubricant bucket for storing lubricant and at least one lubricant pipe coupled to the lubricant bucket and a pivot setting location on a rotating axis of the motor.

5. The jet burner according to claim 1, wherein the wind speed auxiliary unit is installed with at least one hatch cover disposed at a bucket side of the wind speed bucket, wherein the hatch cover is capable of opening and closing.

6. The jet burner according to claim 1, wherein the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a bucket side of the wind speed bucket, wherein the hatch cover is capable of opening and closing.

7. The jet burner according to claim 3, wherein the high-pressure gas supplying unit is further installed with an air compressor coupled to the gas storage bucket, and the air compressor is electrically connected to the control circuit of the control unit.

8. The jet burner according to claim 3, wherein the high-pressure gas supplying unit is further installed with an air compressor coupled to the gas storage bucket, and the air compressor is electrically connected to the control circuit of the control unit; and the wind speed auxiliary unit is installed with a lubricant bucket for storing lubricant and at least one lubricant pipe coupled to the lubricant bucket and a pivot setting location on a rotating axis of the motor.

9. The jet burner according to claim 3, wherein the high-pressure gas supplying unit is further installed with an air compressor coupled to the gas storage bucket, and the air compressor is electrically connected to the control circuit of the control unit; and the wind speed auxiliary unit is installed with at least one hatch cover disposed at a bucket side of the wind speed bucket, wherein the hatch cover is capable of opening and closing.

10. The jet burner according to claim 3, wherein the high-pressure gas supplying unit is further installed with an air compressor coupled to the gas storage bucket, and the air compressor is electrically connected to the control circuit of the control unit; the wind speed auxiliary unit is installed with a lubricant bucket for storing lubricant and at least one lubricant pipe coupled to the lubricant bucket and a pivot setting location on a rotating axis of the motor, and the wind speed auxiliary unit is installed with at least one hatch cover disposed at a bucket side of the wind speed bucket, wherein the hatch cover is capable of opening and closing.

11. The jet burner according to claim 1, wherein the air blower is disposed at a rear end of the burning chamber, and a wind blowing direction of the air blower is parallel to an axis of the burning chamber.

12. The jet burner according to claim 1, wherein the air blower is coupled to the burning chamber via a pipe line.

* * * * *